US007011267B2

(12) United States Patent
Koutonen et al.

(10) Patent No.: US 7,011,267 B2
(45) Date of Patent: Mar. 14, 2006

(54) METHOD AND DEVICE FOR WINDING A PAPER OR BOARD WEB

(75) Inventors: Pauli Koutonen, Jokela (FI); Heikki Föhr, Järvenpää (FI); Markku Järvensivu, Valkeakoski (FI)

(73) Assignee: Metso Paper, Inc., Helsinki (FI)

( * ) Notice: Subject to any disclaimer, the term of this patent is extended or adjusted under 35 U.S.C. 154(b) by 184 days.

(21) Appl. No.: 10/433,759

(22) PCT Filed: Dec. 4, 2001

(86) PCT No.: PCT/FI01/01049

§ 371 (c)(1),
(2), (4) Date: Oct. 10, 2003

(87) PCT Pub. No.: WO02/46076

PCT Pub. Date: Jun. 13, 2002

(65) Prior Publication Data

US 2004/0056142 A1 Mar. 25, 2004

(30) Foreign Application Priority Data

Dec. 7, 2000 (FI) ..... 20002679

(51) Int. Cl.
*B65H 18/08* (2006.01)
*B65H 75/24* (2006.01)

(52) U.S. Cl. ..... 242/530.1; 242/578; 242/578.2; 242/534

(58) Field of Classification Search ..... 242/530.1, 242/530.3, 534, 578, 578.2
See application file for complete search history.

(56) References Cited

U.S. PATENT DOCUMENTS

| | | | | |
|---|---|---|---|---|
| 3,792,820 | A | 2/1974 | Lucas | |
| 4,358,066 | A | 11/1982 | Deutschle et al. | |
| 4,444,364 | A | 4/1984 | Dahl et al. | |
| 4,867,389 | A | 9/1989 | Scheuter | |
| 6,299,099 | B1 * | 10/2001 | Miller et al. | 242/529 |

FOREIGN PATENT DOCUMENTS

| | | |
|---|---|---|
| EP | 0 861 797 A1 | 9/1998 |
| FI | 86284 | 4/1992 |
| WO | WO 98/23514 A1 | 6/1998 |
| WO | WO 02/46076 A1 | 6/2002 |

OTHER PUBLICATIONS

Search Report issued in Finnish Priority Application No. 20002679.
International Search Report issued in International Patent Application No. PCT/FI01/01049.
International Preliminary Examination Report issued in International Patent Application No. PCT/FI01/01049.

* cited by examiner

*Primary Examiner*—Kathy Matecki
*Assistant Examiner*—Sang Kim
(74) *Attorney, Agent, or Firm*—Stiennon & Stiennon

(57) ABSTRACT

In paper winding, separate rolls are formed side by side around roll cores (10*a*, 10*b*) placed one after the other while supported by support members. The cores are pressed at their ends against one another by core chucks (20) arranged in connection with the free ends of the outermost roll cores (10*a*, 10*b*). The roll cores (10*a*, 10*b*) are placed in a desired position and subjected to a desired compression force by the core chucks (20), the length of the row of roll cores (10*a*, 10*b*) is determined, and the compression force of at least one core chuck (20) is regulated during winding when the length of the roll core row changes to keep the compression force and/or the length of the roll core row within desired limits.

10 Claims, 1 Drawing Sheet

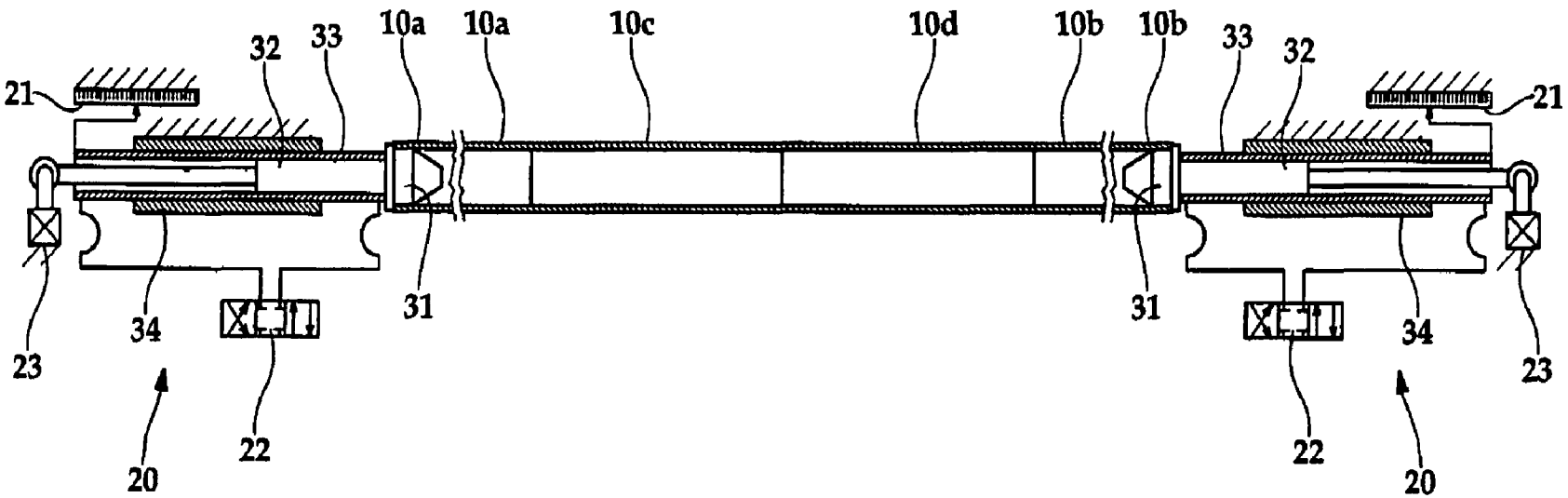
21
23
34
20
32
22
33
10b
31
10b
10d
10c
10a
10a
31
33
32
22
34
20
21
23

METHOD AND DEVICE FOR WINDING A PAPER OR BOARD WEB

CROSS REFERENCES TO RELATED APPLICATIONS

This application is a U.S. national stage application of International Application No. PCT/FI01/01049, filed Dec. 4, 2001, and claims priority on Finnish Application No. 20002679, filed Dec. 7, 2000, the disclosure of each application being hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In two-drum winders, in which narrower component webs slit with a slitter-winder from a web unwound from a machine reel are wound into customer rolls, the rolls are usually placed side by side on two winding drums. Because of variations in the cross-direction profiles, for example, thickness, moisture and roughness, of the web to be wound, adjacent rolls are not formed with precisely equally large diameters, in spite of the fact that, in principle, precisely equally long component webs are wound into them. Owing to the different diameters of the rolls, the roll cores placed in the roll centres are displaced with the progress of winding in relation to one another so that their centres of rotation are separated and, at the same time, minor variations also occur in the angular speeds of the rolls. Since the roll centres are, however, in contact with each other during the entire winding process, diverting forces arise between the ends of the roll cores, and the rolls tend to "jump", in which connection the rolls that are being formed can be damaged. Owing to this detrimental vibration, in two-drum winding, it is generally necessary to run at a lower speed, i.e. to be content with a lower winding speed, which reduces the capacity of the machine and is, thus, uneconomical.

The problem described above has occurred as long as winders of the two-drum type have been in use. The seriousness of the problem has, however, varied in the course of the years, because the profile of the web produced on a paper machine has improved and, at the same time, the roll size and the winding speed have changed only to a small extent. In recent years, the diameters of the customer rolls produced have started becoming ever larger and, at the same time, the winding speeds have also increased, for which reason the problem of vibration has been noticed again: even a little variation of profile in the direction of width of the web is cumulated especially during winding of thin paper grades so that faults in the shape of the rolls which arise from the web profile cause a significant vibration problem.

In the winding process, a number of different phenomena are effective which attempt to shift the web rolls that are being formed in their axial direction:

- deflection of winding cylinders, i.e. winding drums,
- faults in the shape of the rolls arising from uneven profile of the web, and
- also the core chucks, which support the roll cores of the outermost web rolls, subject the row of rolls to axial forces when they keep the row of rolls in the desired position.

The core chucks alone can also produce a compression force applied to the whole row of roll cores when the roll cores are excessively long: the total length of the roll cores is higher than the regulated distance between the core chucks.

One problem in winding is also that the length of the roll cores, for example, roll spools, changes during winding because with some core and paper qualities the compression pressure caused by the web being wound onto the core gives rise to elongation of cores.

When roll cores are pressed in their position at their ends by means of core chucks, another problem is often that there is either too much or too little pressing. In a situation where the core chucks press too much, the vibration problems described above arise and if the chucks are again too loose, there are lateral shifts. Because of the problems of the type described above, determining of the correct pressing force and position of the core chucks is very problematic.

The phenomena described above can, either alone or together, produce situations in which the rolls or the ends of the roll cores tend to be pressed against each other and thereby to produce a relative support force, thus causing vibration problems.

Thus, there are several factors that produce a relative axial thrust force between the rolls. The core chucks, which keep the outermost roll cores in their positions, keep the row of rolls in the correct winding position in the lateral direction, but deflection of the winding drums drives the rolls towards the lowest point of deflection. Variations in the web profile produce a "carrot shape" even in individual rolls, in which case the rolls tend to move in the lateral direction. Of course, variations in the lengths of the roll cores, together with the core chucks, cause variation in the axial forces in different forms. It comes out from the above that there are a number of different reasons why the rolls tend to be pressed against each other during winding, thus generating vibration that limits running speeds and even damages the rolls.

The problems described above occur in all such winder types in which the location/support of the web rolls that are formed comply with the following terms:

- the roll cores (web rolls) are placed one after the other coaxially so that the location of each roll core is determined by means of the adjacent roll cores,
- the roll cores (web rolls) are supported under optimal conditions in the radial direction of the rolls only (the core chucks just prevent axial movement arising from faults in the roll shapes and from deflection of the winding members).

SUMMARY OF THE INVENTION

It is an object of the invention to provide a method and a device which, when used, eliminate or at least minimize the problems described above.

A particular object of the invention is to provide a method and a device in which the compression force and/or position of the core chuck can be adjusted in an optimal manner.

In accordance with the invention, measuring devices for measuring the position and force of the chuck as well as machine controls for controlling the operation of the core chuck are arranged in connection with the core chuck such that the position and/or the force of the chucks is/are in a desired value range, i.e. within desired limits, and no detrimental vibration is generated because of axial forces of detrimental magnitude between the roll cores. In accordance with an advantageous embodiment of the invention, core chucks according to the invention are placed at both ends of a row of roll cores. However, in accordance with the invention it is also possible to place such an inventive core chuck with its measuring devices and control arrangements only at one end of a row of core chucks.

In accordance with the invention, after feeding the roll cores, for examples, roll spools, the roll cores are placed by means of core chucks in positions in compliance with the trim, i.e. desired component web widths, and the length of the row of roll cores is measured by means of position and compression pressure sensors placed in the core chucks. During winding, when the length of the roll cores changes, the axial compression force of both chucks is most advantageously kept within desired limits, for example, at a set value by adjusting the position of both chucks in a centralized manner.

The trim data in accordance with the invention, i.e. information about the width of the web rolls to be wound, is obtained from the control system of the machine and the length of the roll core set, by which are meant the roll cores which are placed side by side in a row in an abutting relationship with respect to each other and which are situated between the core chucks, is measured when the core chucks have been placed in the desired pressing position. When needed, the position of the core chuck/chucks is adjusted in a centralized manner.

In the position measurement in accordance with the invention, a position sensor is advantageously used as the measuring device and in the force measurement in accordance with the invention, a pressure or force sensor is advantageously used as the measuring device.

The necessary machine controls of the core chucks are advantageously accomplished by means of electric, hydraulic and/or pneumatic actuators.

BRIEF DESCRIPTION OF THE DRAWINGS

In the following, the invention will be described in more detail with reference to the FIGURE of the appended drawing, to the details of which the invention is, however, not by any means meant to be narrowly confined, which FIGURE schematically shows core chucks in accordance with one advantageous application of the invention.

DESCRIPTION OF THE PREFERRED EMBODIMENTS

The FIGURE has been cut such that in the middle of the FIGURE there are cores 10*c* and 10*d* in addition to the outermost cores 10*a*, 10*b* of a row, onto which cores the component webs produced in slitting are wound.

As shown in the FIGURE, a core chuck 20 is placed at either end of the core set 10*a*, 10*b*, said core chuck comprising measuring devices 21 for measuring the position of the core chuck 20 and measuring devices 23 for measuring compression force. In addition, the system comprises control devices 22 for adjusting the position of the core chucks 20 as desired based on the result of measurement. In other respects, the core chuck 20 is accomplished in a manner known in itself from the prior art such that it comprises a conical part placed inside the core 10*a*, 10*b*, a fixing part 31 which can be moved in the direction of the row of cores 10*a*, 10*b* to produce a desired compression force by means of an actuator, for example, a hydraulic, electric or pneumatic actuator, which is arranged to be movable in a shaft 33 placed inside frame parts 34 of the core chuck 20.

The measuring device 21 for measuring the position of the core chuck 20 is advantageously an absolute position sensor. A pressure or force sensor is advantageously used as the measuring device 23 for measuring the compression force of the core chuck 20. The control devices 22 used for controlling the operation of the core chuck 20 are electric, hydraulic and/or pneumatic actuators. Advantageously, the measuring devices 21, 23 and the control devices 22 of both core chucks are arranged to cooperate such that the position of the core chucks 20 can be adjusted in a centralized manner.

In accordance with the invention, the operation of the core chuck 20 is controlled such that the position of the core chucks is as desired and their axial compression force is within desired/set values. The desired compression force is produced, for example, by the moment of a motor, by hydraulic or pneumatic cylinders provided with feedback to the force or pressure sensor. When needed, desired limit values can also be set for the position of the core chucks, in which connection the regulation of the axial compression force takes place based on distance limits.

Above, the invention has been described with reference to one of its advantageous embodiment examples only, to the details of which the invention is not by any means intended to be narrowly confined.

The invention claimed is:

1. A method of winding comprising the steps of:

forming separate rolls, each roll having two ends, wherein the separate rolls are formed side by side around roll cores placed one after the other to form a row of rolls, and thereby define outermost roll cores which have free ends, the separate rolls being formed while supported by support members;

pressing the roll cores at their ends against one another by two core chucks arranged in connection with the free ends of the outermost roll cores, placing the roll cores in a selected position and subjecting the roll cores to a selected compression force by the core chucks;

measuring the length of the row of rolls with a position sensor and a compression pressure sensor forming part of one of said two core chucks; and regulating the compression force of at least one core chuck during winding within selected limits with respect to at least one of the compression force or the length of the roll row.

2. The method of claim 1 wherein the step of regulating the compression force is performed by adjusting the position of both core chucks.

3. The method of claim 1 wherein control devices are arranged to position the core chucks and to cooperate such that the positions of the core chucks are adjusted in a centralized manner.

4. A method of winding comprising the steps of:

forming separate rolls, each roll having two ends, wherein the separate rolls are formed side by side around roll cores placed one after the other to form a row of rolls, and thereby define outermost roll cores which have free ends, the separate rolls being formed while supported by support members;

pressing the roll cores at their ends against one another by two core chucks arranged in connection with the free ends of the outermost roll cores, placing the roll cores in a selected Position and subjecting the roll cores to a selected compression force by the core chucks;

determining the length of the row of the rolls; and regulating the compression force of at least one core chuck during winding with respect to at least one of the compression force or the length of the roll row, within selected limits;

wherein the position of the core chuck(s) is measured to measure the length of the roll core row.

5. A winding machine comprising:

a plurality of support members;

a plurality of separate rolls forming side by side around roll cores placed one after the other, while supported by the support members;

a first core chuck arranged in connection with a first free end of a first outermost roll core;

a second core chuck arranged in connection with a second free end of a second outermost roll core;

the first core chuck having a first measuring device for measuring the position of the first core chuck and a second measuring device for measuring the compression force of the first core chuck;

the first core chuck having a first control device(s) for controlling the operation of the first core chuck during winding to keep the position of the first core chuck within selected values and to keep the compression force within selected values.

6. The apparatus of claim 5, wherein the second core chuck has a third measuring device for measuring the position of the second core chuck; and the second core chuck has a fourth measuring device for measuring the compression force of the second core chuck; and further comprising:

a second control device(s) for controlling the operation of the second core chuck during winding to keep the position of the second core chuck within selected values; and to keep the compression force within selected values.

7. The apparatus of claim 6, wherein the first, second, third and fourth measuring devices and the first, and second control devices are arranged to cooperate such that the position of the first and second core chucks can be adjusted in a centralized manner.

8. The apparatus of claim 5, wherein the first measuring device for measuring the position of the core chuck is a position sensor.

9. The apparatus of claim 5, wherein the second measuring device for measuring the compression force of the first core chuck is selected from the group consisting of: a moment sensor, a pressure sensor, or a force sensor.

10. The apparatus of claim 5, wherein the control device for controlling the operation of the first core chuck is selected from the group consisting of: hydraulic actuators, electric actuators, or pneumatic actuators.

* * * * *

UNITED STATES PATENT AND TRADEMARK OFFICE

CERTIFICATE OF CORRECTION

PATENT NO. : 7,011,267 B2 
DATED : March 14, 2006
INVENTOR(S) : Pauli Koutonen et al.

It is certified that error appears in the above-identified patent and that said Letters Patent is hereby corrected as shown below:

Title page,
Item [56], References Cited, U.S. PATENT DOCUMENTS, insert
-- 3,878,999 A 4/1975 Daves --.

Signed and Sealed this

Thirteenth Day of June, 2006

JON W. DUDAS
*Director of the United States Patent and Trademark Office*